United States Patent [19]

Pappas

[11] 4,101,872

[45] Jul. 18, 1978

[54] FIRE DETECTION SYSTEM

[75] Inventor: Dennis Gerasimos Pappas, New York, N.Y.

[73] Assignee: Aboyne Pty. Limited, Sydney, Australia

[21] Appl. No.: 585,537

[22] Filed: Jun. 10, 1975

[30] Foreign Application Priority Data

Jun. 18, 1974 [AU] Australia ..... 7893/74

[51] Int. Cl.[2] ..... G08B 1/08

[52] U.S. Cl. ..... 340/539; 340/164 R; 325/31; 325/64

[58] Field of Search ..... 340/286, 224, 409, 413, 340/164 R; 325/31, 40, 64, 66

[56] References Cited

U.S. PATENT DOCUMENTS

| | | | |
|---|---|---|---|
| 3,508,260 | 4/1970 | Stein | 340/408 |
| 3,513,443 | 5/1970 | Andersen | 340/164 R |
| 3,703,000 | 11/1972 | Kaplan | 340/276 |
| 3,902,478 | 9/1975 | Konopasek et al. | 340/224 |

*Primary Examiner*—John W. Caldwell, Sr.
*Assistant Examiner*—Donnie L. Crosland
*Attorney, Agent, or Firm*—Ladas, Parry, Von Gehr, Goldsmith & Deschamps

[57] ABSTRACT

A fire detection system for use in buildings is provided with transmitters which are listened to by remote receivers and which indicate the present conditions such as fire, smoke or dust, which are to be guarded against. The transmitters have a monitoring mode in which the monitoring mode signal is detected by the receivers within predetermined recurring successive intervals of time which are long relative to the time periods between successive monitoring mode signals and which are very long indeed compared with the duration of each monitoring mode signal.

11 Claims, 9 Drawing Figures

FIRE DETECTION SYSTEM

FIELD OF THE INVENTION

This invention relates to the transmission of information, preferably by way of a radio frequency (R.F.) signal transmission.

The invention has particular (although non-exclusive) application in the field of fire detection and, for convenience of reference, is hereinafter described in this context.

STATE OF THE ART

Radio frequency signal transmission systems are known in relation to fire detection. Such systems employ R.F. transmitters which are individually coupled to, for example, an associated thermal or smoke level detector, and the transmitters are actuated into either an active state or a passive state (whichever is required by design considerations) upon detection of a predetermined change in prevailing thermal conditions or upon detection of a predetermined smoke level intensity. The transmitters are employed in conjunction with remote receivers (one only receiver being normally arranged to receive and detect signals from a number of transmitters), and in conjunction with a control or indicator panel which is wired in circuit with the receivers. Typically, a number of transmitters would be strategically located about each level of a multistory building, and one receiver would be located at each level of the building to detect for signals emanating from the transmitters at the respective levels. Signals which are detected by the receivers initiate further signals which are conveyed by wires to the common control or indicator panel.

The transmitters (which incorporate the thermal or smoke level detectors) as above described are customarily individually powered by self-contained dry cell type batteries, this permitting placement of the transmitters without the need to provide for electrical wiring (to the transmitters) from a mains supply.

In order to provide for fail-safe operation, fire detection systems which incorporate R.F. signal transmission must be monitored. This is traditionally achieved in one of two general ways. The systems are designed either to provide for a continuous transmission of R.F. signals, with a break in transmission indicating either a fire alarm condition or a transmitter failure, or to provide for automatic monitoring (i.e., wireless interrogation) of transmitters which are designed to remain passive under normal conditions.

However, both of the modes of achieving fail-safe operation have inherent problems. Systems which provide for continuous signal transmission under "normal" conditions impose a high, continuous current drain on the transmitter's battery, whilst systems which employ interrogation techniques for checking the operational capacity of the transmitters are inherently expensive in terms of electronic hardware.

These problems might be alleviated by arranging for the transmitters to emit periodic monitoring signals and, when required, alarm signals at a distinguishably faster repetition rate. However it is predicted that such a "simple" system could give rise to further problems.

Thus, in operation of such a system it is possible and, indeed, most likely that a receiver would receive signals randomly from two or more of a number of transmitters within and/or without any one building. Under these circumstances, a monitoring signal which should be detected by the receiver might be rejected, due to simultaneous reception of monitoring signals from more than one transmitter and interference of those signals.

This rejection of an otherwise legitimate monitoring signal could result in the receiver giving indication, erroneously, of a fault condition at the transmitter.

OBJECT OF THE INVENTION

The present invention seeks to avoid this problem, without restoring to synchronization of transmitter emissions, by providing a system which assumes correct operation of the transmitters in the monitoring mode if at least one monitoring mode signal is detected within predetermined (successive) intervals of time which are long relative to the time periods between successive monitoring mode signals and which are very long relative to the duration of each monitoring mode signal.

THE INVENTION

Thus, the present invention provides an information transmission system comprising:

(a) a signal transmitter (preferably a radio frequency signal transmitter) which is arranged to transmit in two modes, one of which being a monitoring mode wherein monitoring mode signals which have a duration $\delta t$ and which are spaced apart by time $t$ ($>> \delta t$) are employed to modulate a carrier signal, and the other of which being an alarm mode which is established responsive to the existence of an alarm inducing condition and wherein alarm mode signals having a repetition rate greater than the repetition rate of the monitoring mode signals are employed to modulate the carrier signal, and (b) a receiver which is arranged to receive and detect signals from the transmitter, the receiver being arranged to provide an output responsive to a change occurring in the mode of transmission by the transmitter or if no signal having the duration $\delta t$ is detected within each period of successive predetermined (fault detecting) periods of time $xt$ ($> t$).

PREFERRED FEATURES OF THE INVENTION

The information transmission system would normally be employed in conjunction with a sensor which would be arranged to detect for the existence of the alarm inducing condition, the sensor being associated with the transmitter.

Preferably, the alarm mode signals have the same composition as the monitoring mode signals, the only difference between the respective transmissions being in the repetition rate of the signals. Also, the signals are each preferably composed of a train of pulses.

Furthermore, the respective alarm mode signals preferably have the same duration ($\delta t$) as the monitoring mode signals, the alarm mode signals being spaced-apart by time $\alpha t$ ($< \delta t$). Then, the receiver would be arranged to provide an alarm indicating output if at least one signal of duration $\delta t$ is received and detected within a period of time $\beta t$ ($\alpha t \leqq \beta t < t$) following receipt of a preceding such signal.

The invention therefore provides a system which is self-monitoring and which is economical in terms of transmitter power consumption. Such economy is achieved by making the repetition rate of the monitoring mode signal very small in relation to the repetition rate of the alarm mode signal.

Also, the system provides for automatic surveillance of the transmitter because the receiver functions to:

1. detect the monitoring signal — which indicates normal operation of the transmitter;
2. detect the alarm signal — which indicates the existence of an alarm inducing condition, and
3. detect the absence of any signal — which indicates a fault condition, such as a 'flat' battery in the transmitter.

As above mentioned, the possibility that an erroneous fault indication would be given by the receiver in relation to an associated transmitter would be very small; due to the very short period ($\delta t$) of each monitoring signal pulse train, and to the short time duration ($t$) between successive pulse trains, relative to the period ($x \cdot t$) allotted for detection of a monitoring mode signal. Thus, it has been established by mathematical studies that, for a given area encompassing 5000 transmitters, if each transmitter when operating in the monitoring mode produces pulse trains at the rate of one per minute ($t$), with each pulse train having a duration of 600 microseconds ($\delta t$), and with a receiver fault detection period ($x \cdot t$) of 10 minutes being adopted, the probability of any one transmitter being not correctly and uniquely monitored would be $10^{-9}$.

The above figures are given for the sole purpose of illustrating the very small probability of incorrect monitoring and they should not be read as representing optimum operational figures. It is likely that the emission of pulse trains having a duration of 600 microseconds would result in a transmission having a bandwidth exceeding that which would be permitted by certain regulatory bodies. However, much the same probability figures can be achieved (if the pulse train duration is increased) by reducing the number of transmitters within a given area and/or by increasing the receiver fault detection period. Alternatively, in certain applications of the system, an increase in the probability of incorrect monitoring might be readily tolerated.

Therefore, with the foregoing in mind, the following (non-limiting) figures are given as being appropriate to the monitoring signal over a range of various applications of the system:

Duration of each pulse train ($\delta t$) — 200 microseconds to 5 milliseconds

Pulse train spacing ($t$) — 30 seconds to 2 minutes

Receiver fault detection period ($xt$) — 5 minutes to 60 minutes)

In certain applications of the system the pulse train spacing ($t$) may be increased substantially; for example, up to 2 hours. Then, the receiver fault detection period ($xt$) would be adjusted accordingly.

Also, the following (non-limiting) figures are given as being appropriate to the alarm signal over a range of various applications of the system:

Duration of each pulse train ($\delta t$) — 200 microseconds to 5 milliseconds

Pulse train spacing ($\alpha t$) — 100 microseconds to 5 milliseconds

Receiver alarm detection period ($\delta t$) — 100 microseconds to 20 seconds.

It should be understood that each said "fault detection period" as referred to herein might consist of a single unit of time over which any incoming signals are sampled, or a predetermined number of updated (shorter) units of time, sampling being affected during each of such shorter units of time. In the latter case the "fault detection period" will be deemed to be composed of the sum of the predetermined number of shorter periods.

In a system having a number of transmitters associated with any one receiver (with the receiver being arranged to distinguish between the addresses of the respective transmitters), the pulse train spacing ($t$) should not be fixed as between respective transmitters. Rather, the value of $t$ should be allowed to drift randomly (within reasonable limits) within any one transmitter so as to substantially reduce the possibility of (synchronised) interference of signals emitting from the transmitters.

The nature or construction of the sensor as referred to above will depend upon the application of the transmission system. In addition to fire detection, the system might be applied to, e.g., security alarms and environmental control systems such as pollution level detectors, and the sensor would be chosen accordingly.

Similarly, the nature of the 'alarm inducing condition' as referred to above will vary with the application of the system.

In the context of a fire detection system, the sensor might comprise a thermal detector which is actuable responsive to the detection of a predetermined temperature level. Thus, the sensor may comprise a "rate of change" type detector or a "fixed temperature" type detector. Alternatively, and by way of further example, the sensor may comprise or embody a smoke level detector which may respond to a predetermined smoke density level.

The system has particular application in a fire alarm system in multistory buildings. As such, a plurality of the detector heads could be strategically placed at points at each level of the building for transmission of signals to one or more receiver(s) which could be located at each level. The receivers at the various levels might then be coupled by way of a transmission line with a single control unit which might be arranged to give an audible and/or visual indication of functional conditions.

Certain circuitry which is not unique to any one receiver and which is common to all receivers associated with any one control unit might be incorporated in a single module in the environment of the control unit.

Each transmitter would normally be arranged to provide for emission of a uniquely coded signal. Such signal may be achieved by amplitude, frequency or phase modulation of a carrier signal.

The invention will be more fully understood from the following description of a preferred embodiment of a fire detection system for installation in a multistory building. Such system is illustrated in the accompanying drawings wherein:

IN THE DRAWINGS

Figure 2:
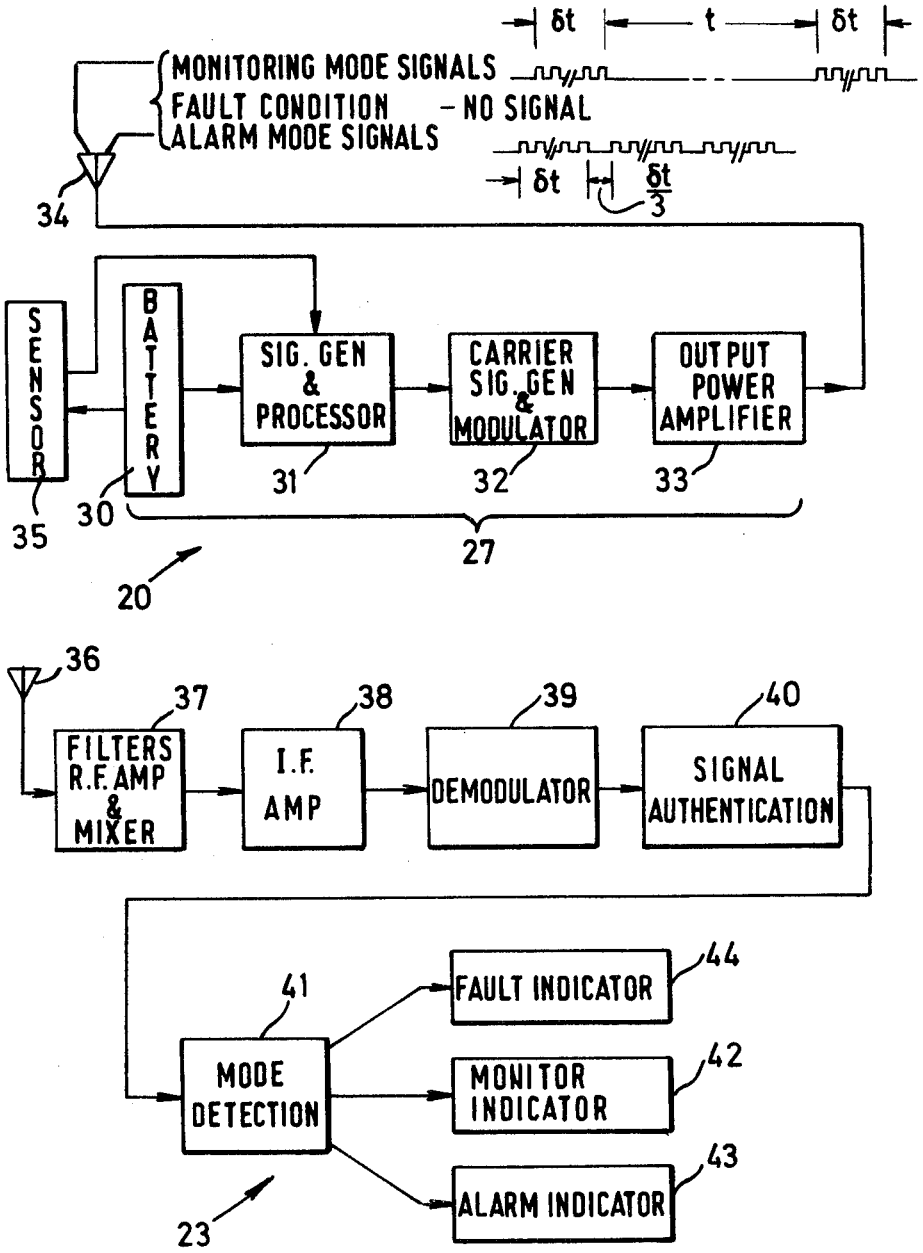
FIG. 2 is a schematic representation of a single sensor transmittor and an associated (remote) receiver forming a part of the system.
Figure 7:
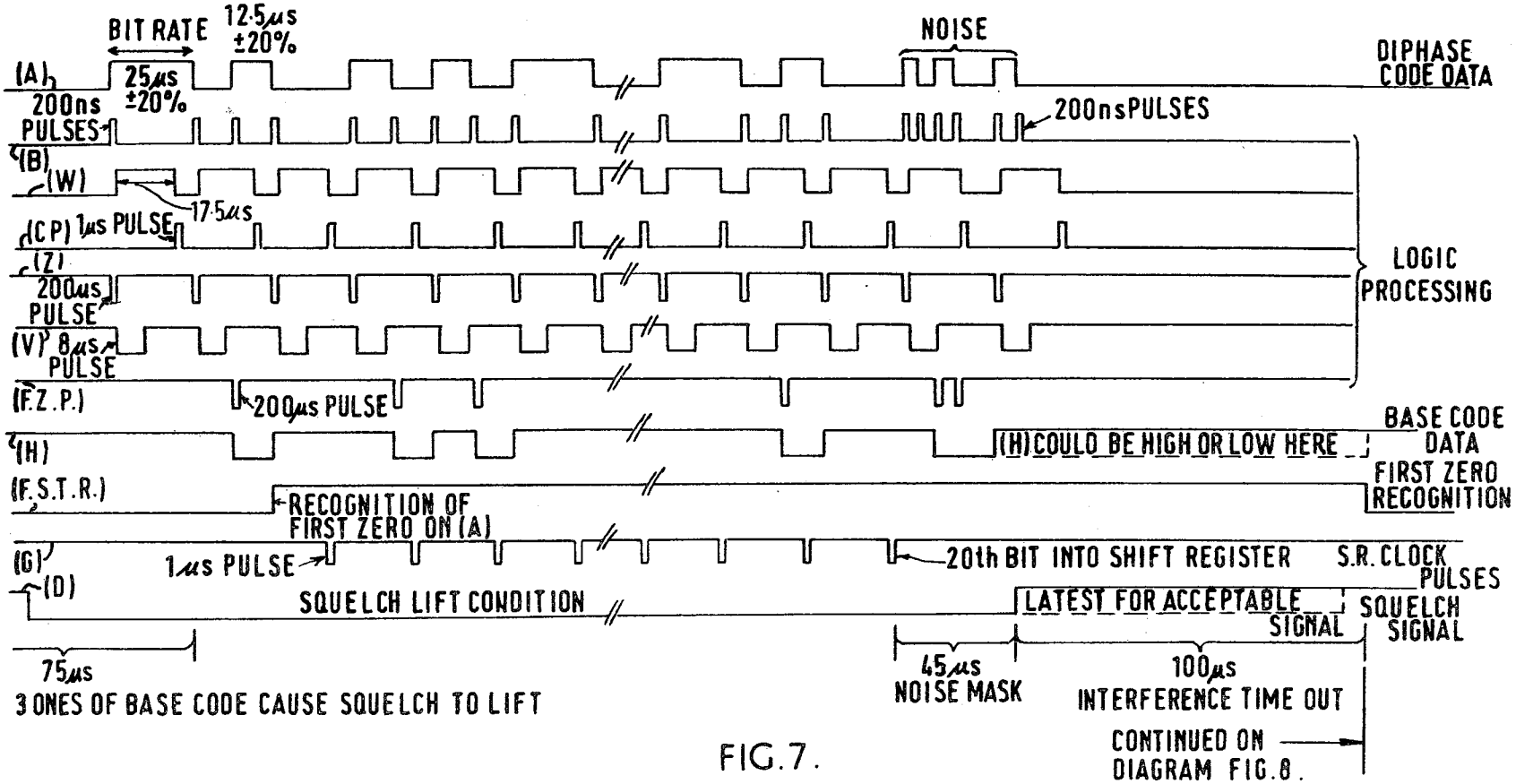
Figure 8:
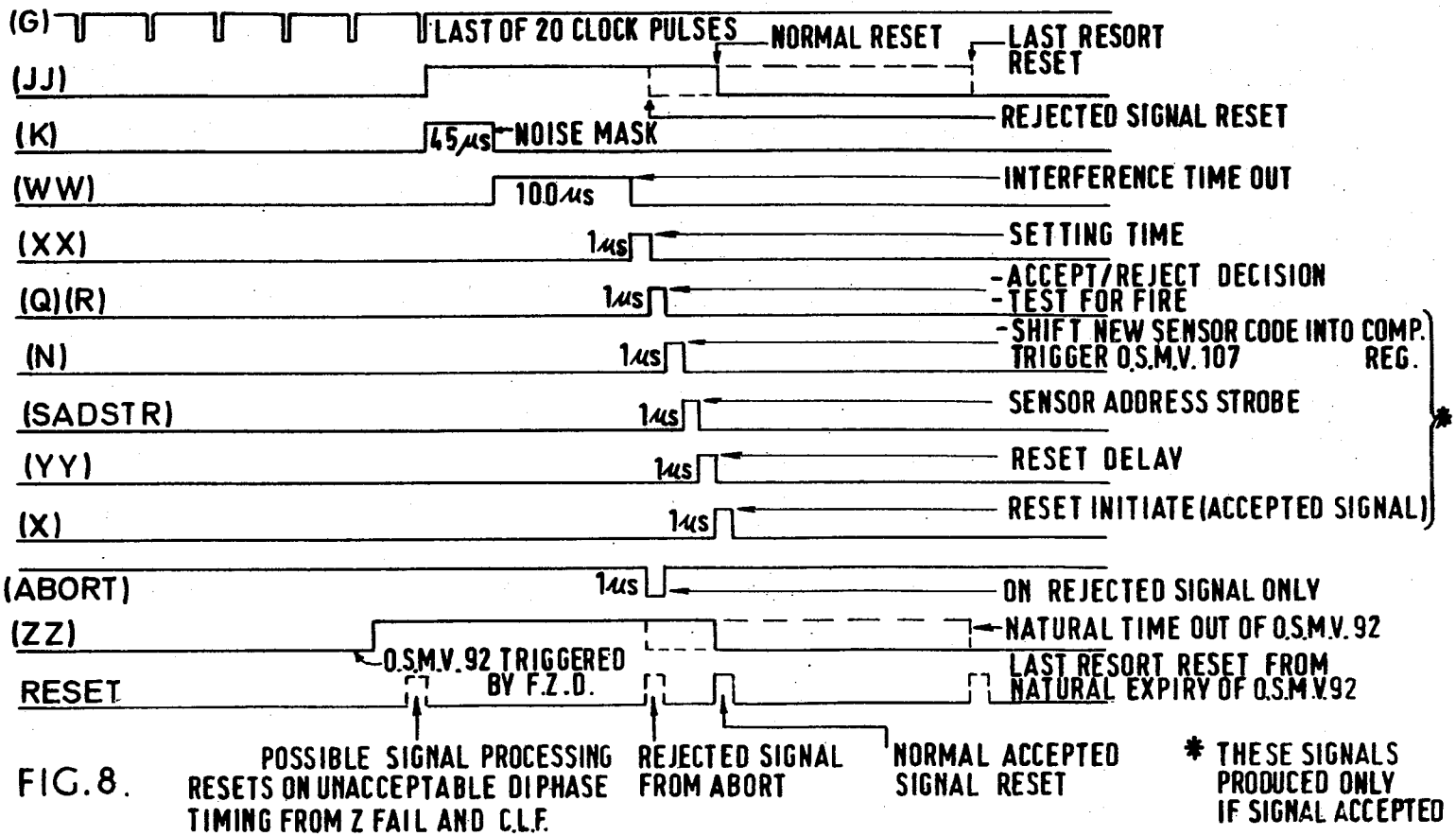

FIGS. 4, 5 and 6A–6B (FIG. 6B being a continuation of FIG. 6A) show the receiver of FIG. 2 in greater detail; and FIGS. 7 and 8 show logic signals and signal timing relationships relevant to the receiver operation.

PREFERRED EMBODIMENT

Figure 1:
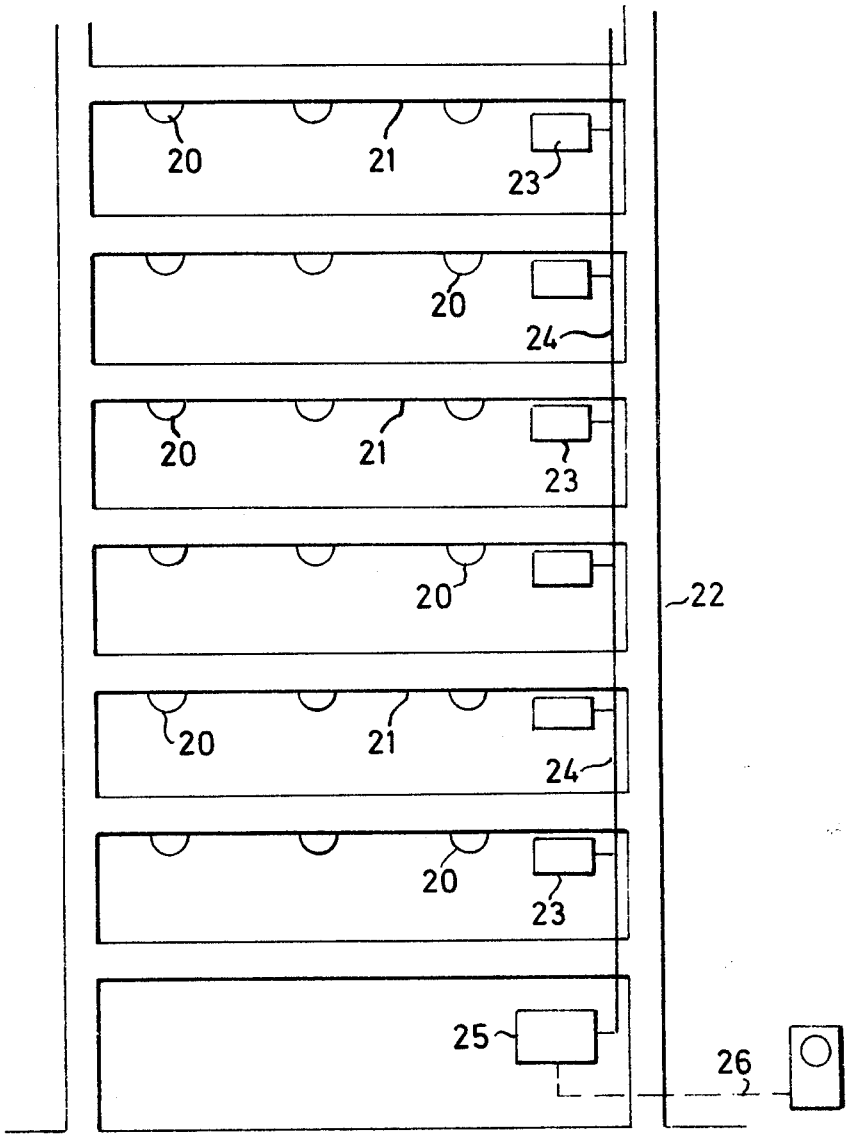
FIG. 1 shows a diagrammatic representation of a multilevel building incorporating the fire detection system.

As shown in FIG. 1 of the drawings, a number of thermal sensor-transmitter heads 20 are mounted to the ceiling 21 at each level of a multi-level building 22. The sensors, which may be of a standard construction and which are ancillary to the present invention, function in a known manner to detect any increases in ambient temperature levels which are sufficiently great as to give indication of the presence of a local fire. Having detected the existence of a local fire condition the sensors function to actuate an integral switching device and this in turn causes an associated transmitter to emit signals in an alarm mode. The actuation of the transmitter and the transmitting process will be hereinafter described.

At least one receiver 23 is located at each level of the building 22 for detection of any signal which is emitted by an associated transmitter, and the receivers are coupled by a cable 24 to a single control unit 25, which would normally incorporate a display panel. The cable 24 would usually be housed in the floor-to-floor service trunking of the building.

The control unit 25 incorporates a local alarm and fault indicating system and it might be coupled by a transmission line 26 to an external alarm in a nearby fire control authority station.

The function and operation of the receivers 23 will be stated in greater detail in the following description.

Each sensor-transmittor head 20 would normally comprise two interconnected casings (not shown), one of which houses the sensor 35 (which might be regarded simply as a thermal switch) and the other of which houses the transmitter 27. The transmitter casing also houses a dry cell type battery 30 for powering the transmitter and for providing a switching current to the sensor. No wire connections are made to the sensor-transmitter heads 20 from an external power supply.

FIG. 2 shows (in schematic form) the relationship between a sensor-transmitter head 20 and an associated receiver 23. FIG. 2 also shows the primary constituent sections of both the transmitter and the receiver.

Each transmitter 27 or, alternatively, each of a number of groups of transmitters is adapted for emission of uniquely coded signals in order that a response might be created only at an associated receiver. The signals are achieved by digital (time division) modulation of a radio frequency carrier signal in the manner to be hereinafter described.

Under normal operating conditions (i.e. when the transmitter 27 is emitting signals in a monitoring mode and the sensor has not been actuated), each transmitter emits coded pulse trains at the rate of one train per minute, with each pulse train having a duration of 600 microseconds. These monitoring mode signals are shown diagrammatically in FIG. 2 with the R.F. carrier component of the signals being omitted for clarity.

When functioning in the alarm mode (i.e., upon actuation of the sensor) the transmitter 27 emits coded pulse trains at a higher repetition rate. Thus, in the alarm mode, a series of 20 pulse trains are emitted, each train having a duration of 600 microseconds (as in the monitoring mode) and the trains being spaced apart by a duration of 200 microseconds. The coding employed in relation to signals emitted in the alarm mode by respective transmitters is the same as the coding employed in relation to monitoring mode signals. The only difference between the signals emitted in the respective modes is the signal repetition rate.

Under fault conditions, such as may occur with battery or component failure, no signals are emitted by the transmitter 27.

The receiver 23, as shown in FIG. 2, functions to detect for signals emitted by an associated transmitter 27 and, also, to detect for any change in the mode of transmission by the transmitter. Concomittently, the receiver also detects for the absence of any signal emission from an associated transmitter and, if no signal detection is made within a predetermined period of 10 minutes, then a fault alarm will be raised.

A more detailed description of the operation of the transmitter and receiver is now given, still with reference to FIG. 2.

The transmitter 27 comprises a battery 30 which energises a signal generator and processor 31 and following components of the transmitter. The signal generator and processor 31 functions to produce a modulating signal which is coded to identify a particular transmitter.

When the transmitter is functioning in the monitoring mode, the modulating signal comprises a series of pulse trains, each having a duration of 600 microseconds and successive trains being separated by a time of 1 minute. The modulating signal is employed to modulate a R.F. carrier signal in a following carrier signal generator-modulator 32 and the composite signal is amplified, in output power amplifier 33, and radiated by an antenna 34.

The battery 30 also serves to deliver current to the sensor 35 which, when caused to actuate by a local fire condition, serves to effect a voltage change at the signal generator and processor 31. This then initiates a change in the operation of the processor, whereby a modulating signal is generated to comprise a series of pulse trains, each having the same duration as those generated in the monitoring mode, but the successive trains being separated by only 200 microseconds.

Any output from the transmitter 27 is received by way of the antenna 36 of the receiver 23 and is processed in the R.F. and I.F. stages 37 and 38 of the receiver. These stages utilise conventional circuit configurations.

Thereafter, the output from the transmitter is demodulated in a demodulator 39 and the signal is authenticated in what might be termed an authentication stage 40. In the authentication stage, the received signal is checked for interference, for presence of noise and for acceptable coding.

The signal having been "authenticated", is analysed in a mode detector 41 which does, in fact, form an integral part of the signal authentication stage and which detects for the mode of transmission. The mode detector functions to provide an output under one or other of the following conditions:

i. If at least one (authenticated) 600 microsecond pulse train is received and detected within 1 to 10 minutes of a preceding (similarly authenticated) pulse train, then the mode detector 41 will provide an output to indicate correct functioning of the system in the monitoring mode. The indication is given by way of a monitoring indicator 42.

ii. If at least one (authenticated) 600 microsecond pulse train is received and detected within 200 microseconds to 16 milliseconds of a preceding pulse train, then the mode detector will provide an output to indicate functioning of the system in the alarm mode. This indication is given by way of an alarm indicator 43.

iii. If no authenticated pulse train is received within a period of 10 minutes following recepit of a preceding (authenticated) pulse train, then the mode detector 41 will provide an output to indicate a fault condition in the system. This indication is given by way of a fault indicator 44.

The transmitter 27 would normally be functioning in the monitoring mode, so it may be simply stated that the receiver provides a response to a change in transmission from the monitoring mode to the alarm mode or if no signal transmission is detected within each period of successive 10-minute periods.

The transmitter and receiver configurations are shown in schematic form only in FIG. 2, in the interest of achieving a simplified description of the general operation of the system. A more detailed description of the system is now given with reference to FIGS. 3 to 8 of the drawings.

Figure 3:
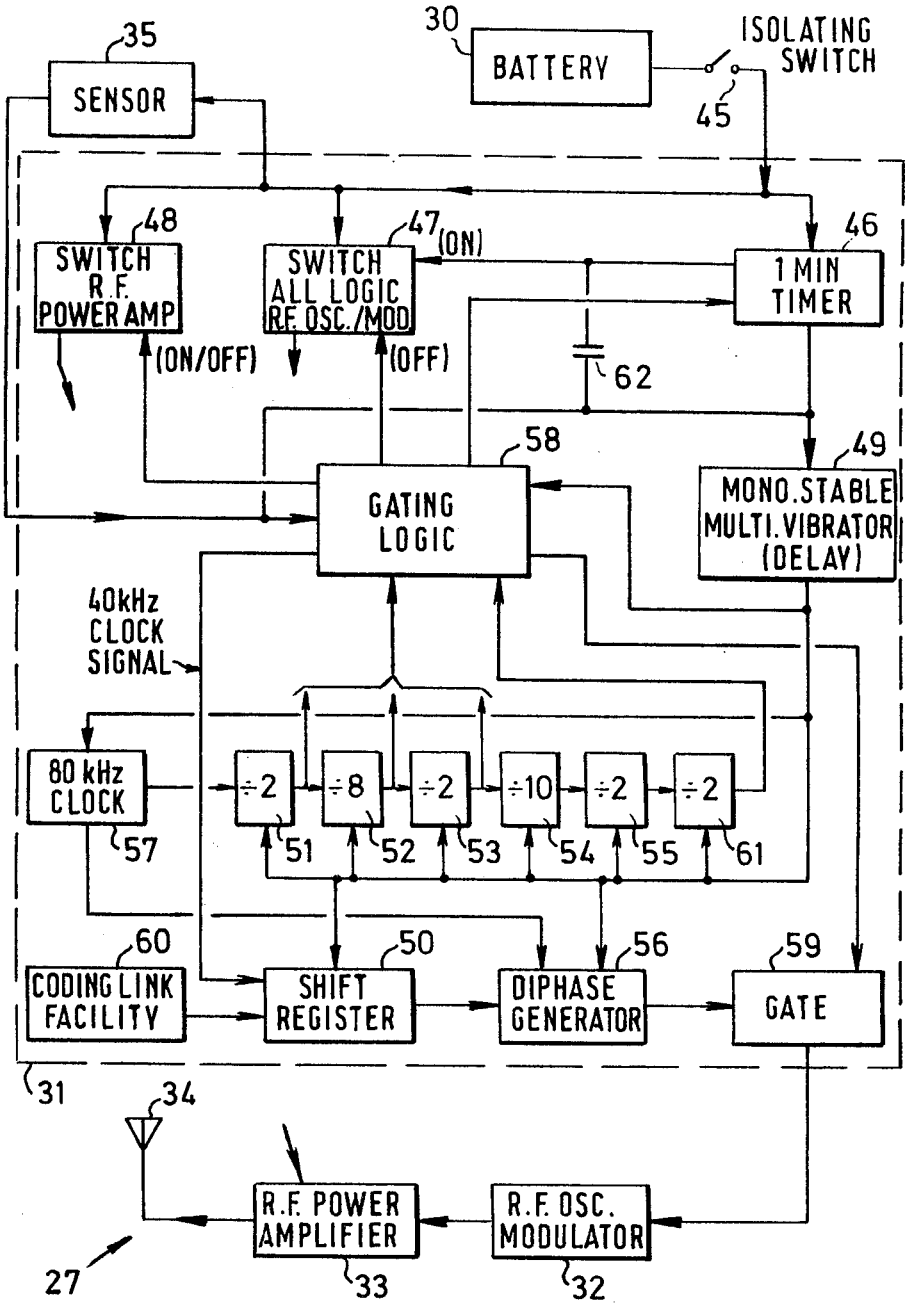
FIG. 3 shows a transmitter of FIG. 2 in greater detail.
Figure 4:
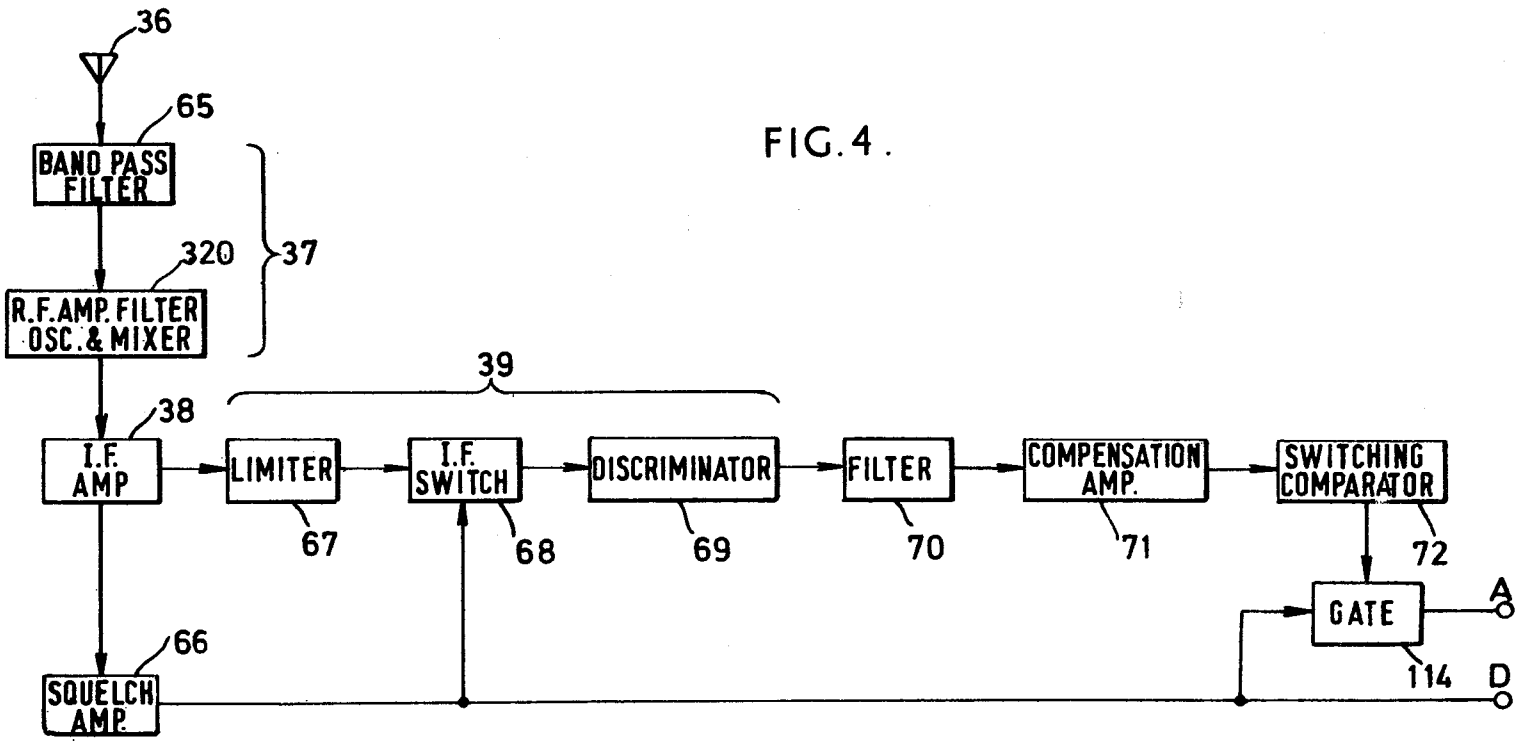
Figure 5:
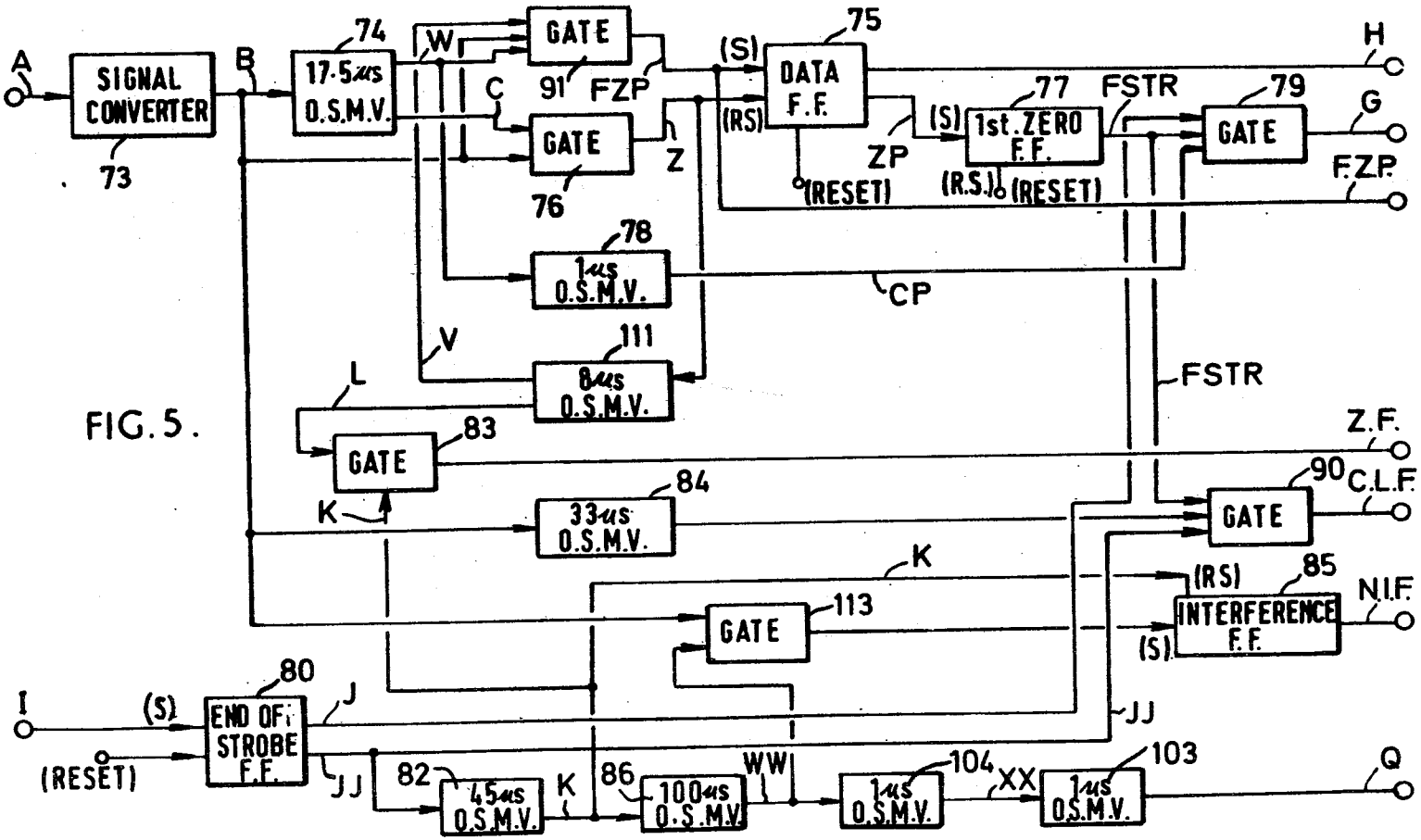
Figure 6A:
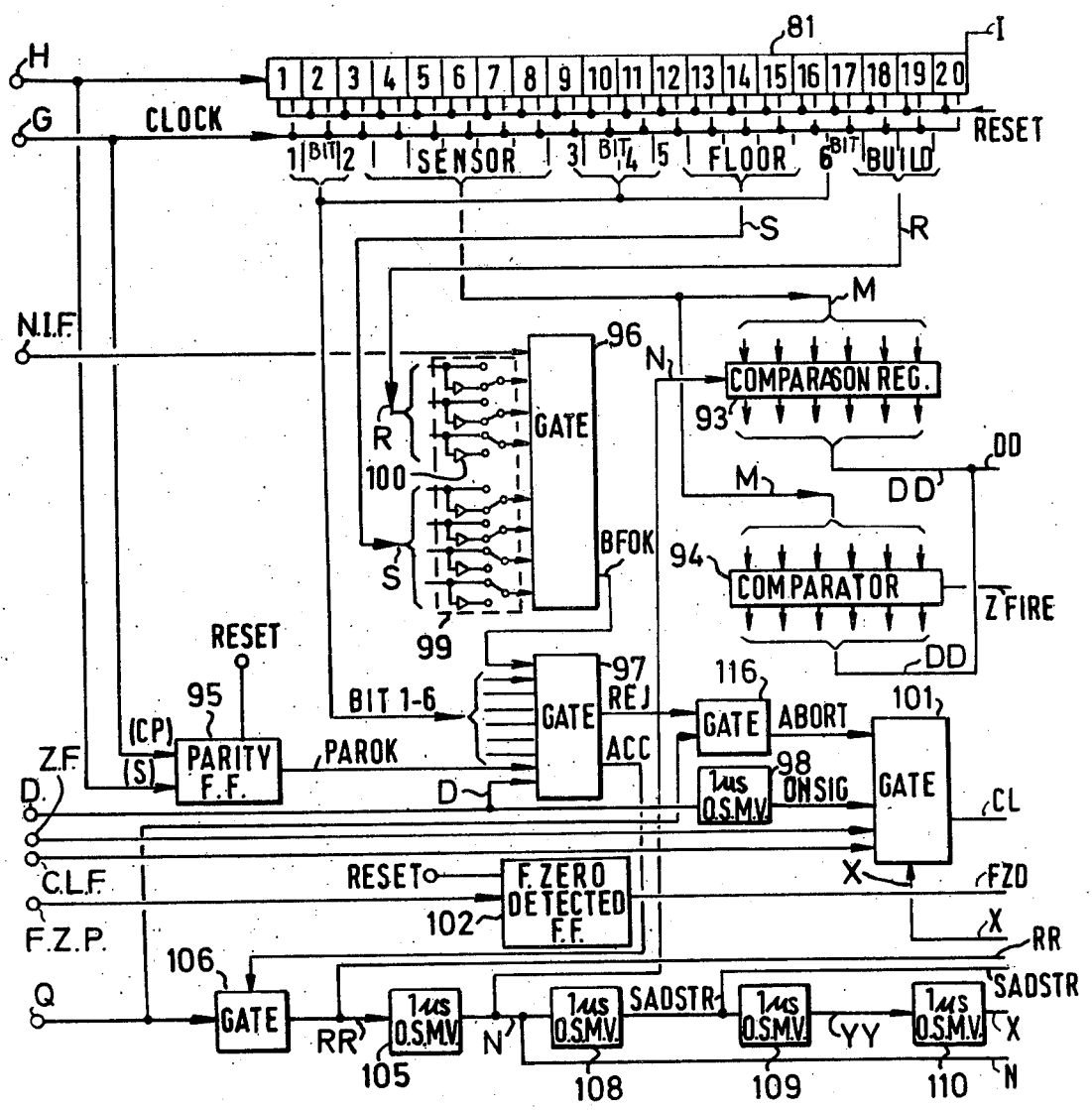
Figure 6B:
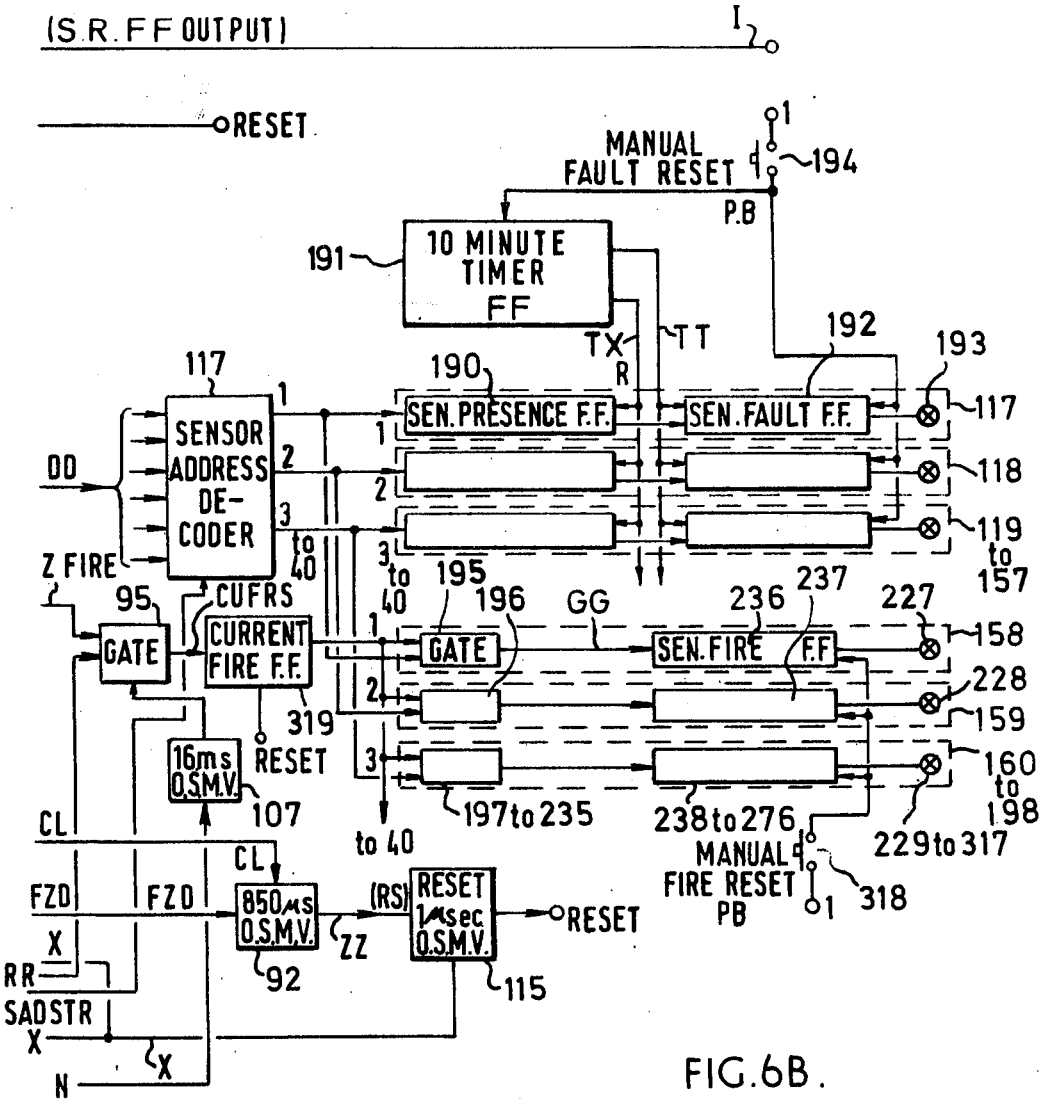

The transmitter 27, as shown in FIG. 3, comprises the battery 30 which provides power through a manually operated isolating switch 45 to a 1-minute timer 46, to a switching device 47 which in turn provides power to all circuitry constituting the signal generator and processor 31 and to the R.F. oscillator-modulator 32, to a further switching device 48 which provides power to the R.F. power amplifier 33, and to the (normally-closed) sensor (thermal switch) 35. Power through the sensor is applied as a gate controlling signal to a gating logic circuit 58.

The 1-minute timer 46 provides a trigger pulse which triggers-on the switching device 47. It also activates a (delay) mono-stable multivibrator 49 which provides an inhibit period of length sufficient to permit stabilization of the R.F. oscillator 32, and to permit a 24-bit code to the shift-loaded into a shift register 50 from a coding link facility 60. During this same inhibit period dividers 51 - 55 and 61 are cleared, a diphase generator 56 is also cleared and reset, and a 80 kHz clock 57 is prevented from clocking.

The (delay) multivibrator 49 also provides an inhibit signal to the gating logic block 58, which utilises the signal to prevent the transmission of an output from the diphase generator 56 to the R.F. oscillator 32, via a gate 59.

At the end of the inhibit period, the clock 57 commences clocking and the inhibit signal is removed from the gating logic 58. The gating logic 58 then functions to trigger-on the switching device 48, which then provides power to the R.F. power amplifier 33, and to remove the gating signal at gate 59. Thus, signal transmission then occurs between the diphase generator 56 and the R.F. oscillator 32.

One (square wave) output from the clock 57 is fed into the divider network 51 to 53. The output from the divider 51 provides a 40 kHz clock signal, via the gating logic 58, which causes the shift register 50 to clock-out a base code signal. The base code signal is derived from the coding link facility 60, which generates the coding logic pattern which is shift loaded into the shift register 50.

The logic pattern comprises a series of logic zeros and ones which are generated to represent a selected 24-bit code.

The base code from the shift register 50 is employed to modulate another 80 kHz (square wave) output which is fed from the clock 57 to the diphase generator 56. The modulated output from the diphase generator 56 comprises a signal having a switching rate equal to the modulating signal bit rate whenever a bit of the base code is a logical one, and equal to double the bit rate when a bit of the base code is a logical zero. This diphase generation (or diphase conversion of a base code) is described in greater detail, in conjunction with relevant circuitry, in Australian Patent Specification No. 464,965.

The output from the diphase generator is fed via the gate 59 to the R.F. oscillator 32 where it is employed to frequency modulate an R.F. carrier signal having a (carrier) frequency of 450 mHz. This modulated signal is then amplified in the amplifier 33 and is radiated by way of the antenna 34.

The output from the dividers 52 and 53, when combined in the gating logic 58, produce trigger-off signals which serve to switch-off the switching devices 47 and 48. This has the effect of removing power from the signal generator and processor circuitry 31 excepting from the timer 46 and switches 47 and 48, from the R.F. oscillator 32 and from the R.F. amplifier 33; thereby terminating signal transmission after transmission of a pulse train which is constituted by the 24-bit code.

In the monitoring mode, this cycle is repeated once every 60-seconds; reinitiation of the cycle being controlled by the 1-minute timer 46.

If a signal is being transmitted in the monitoring mode and an alarm condition occurs, the normally-closed sensor switch 35 (which normally provides the gate controlling signal to the gating logic circuit 58) opens to cause a change of state in the controlling signal. This in turn inhibits the trigger-off signals (referred to above) which would otherwise switch-off the switching devices 47 and 48. This inhibiting of the trigger-off signal allows the dividers 51 to 53 to continue counting, and to continue providing an output to the gating logic device 58. The gating logic device 58 then functions to gate the 40 kHz clock signal at timed intervals, so as to inhibit the shift register 50 from clocking-out the base code signal for a period of 200 microseconds following transmission of each pulse train. In addition, an output from the divider 61 is applied to the gating logic device 58 at intervals of 16 milliseconds and this in turn causes switches 47 and 48 to then turn-off. Thus, the signal emission in the alarm mode is restricted to transmission of 20 pulse trains over a total period of 16 milliseconds; each pulse train having a duration of 600 microseconds and the pulse trains being spaced-apart by 200 microseconds.

To prevent reinitiation of the transmitter in the monitoring mode, after it has emitted an alarm mode signal, an inhibit signal is applied to the 1-minute timer 46.

If a signal is not being transmitted in the monitoring mode and an alarm condition occurs (i.e., during the 1-minute period between successive monitoring mode transmissions) the normally closed sensor switch 35 opens. This again serves to inhibit the trigger-off signals which would otherwise switch-off the switching devices 47 and 48 during transmission of the alarm signal.

Since the switches 47 and 48 would be "off" at the time of the alarm condition being sensed, actuation of the sensor 35 also results in a trigger pulse being delivered to the switch 47 by way of a capacitor 62. A trigger pulse is also delivered to the delay multivibrator 49. This then initiates functioning of the transmitter just as if a monitoring mode transmission was to occur, but the cycle repeats as in the manner described above in relation to the alarm mode operation.

It is mentioned at this stage that the 24-bit code which is transmitted by the transmitter (as a series of diphase ones and zeros impressed on the carrier) serves a number of functions. The order (i.e. coding) of the bits is determined by the coding link facility in respective transmitters so as to identify the location or address of the respective transmissions. Three of the bits are used to identify the building in which the transmitter is housed, four are used to identify the building level, and six bits are used to locate the transmitter within the building level. Of the remaining 11 bits, four are used to establish correct operation of the receiver front end and the receiver logic (referred to below), one is a start bit, one is a parity bit, one an end-of-code bit and the remaining four are spare bits.

The logic circuits of a receiver which is located at any one building level may be required to process a very large number of transmissions from transmitters which are located on its own building level and from transmitters at other levels within the same building and from nearby buildings. Therefore, the receiver logic circuits must reject all signals except for transmissions originating from associated transmitters located at the same building level as the receiver.

The way in which this is achieved will be appreciated from the following receiver description, which is given with reference to FIGS. 4 to 8. Some of the receiver components shown in FIG. 4 have been expressly identified in FIG. 2 and common reference numerals are employed.

Following the receiver antenna 36 is a band-pass fitler 65 which serves to reduce noise present in a received signal. The received signal is then amplified in a following two-stage broad band R.F. amplifier-filter mixer 320 where it is (in the last stage) heterodyned with a local oscillator to provide an I.F. signal.

The I.F. signal is amplified in the (fixed gain) I.F. amplifier 38, and one output from the I.F. amplifier is further amplified in a squelch amplifier 66 to provide a squelch signal D. The other output from the I.F. amplifier 38 passes through a two-stage band-pass limiter 67 which, together with a following I.F. switch 68 and discriminator 69 forms a part of the demodulator 39. The I.F. switch 68 functions to mute the system between received transmissions on receipt of the squelch signal D from squelch amplifier 66.

The output from the I.F. switch is fed to the discriminator 69 where the received signal is demodulated to derive the (transmitter-generated) encoded diphase signal. As this signal will contain unwanted frequencies, it is processed in a following filter 70 and compensation amplifier 71.

The output from the compensation amplifier 71 is fed to a switching comparator 72 which provides a signal A via gate 114. The gate 114 is also controlled by the squelch signal D, causing output A to be present only during receipt of a signal at the antenna 36. Output A is thus representative of the transmitted encoded diphase signal.

It should be mentioned at this stage that FIG. 7 shows the relationship between logic signals A, B, W, CP, Z, V, FZP, H, FSTR, G, and D, which will be (or have been) referred to herein. FIG. 8 shows the relationship between timing control signals G, JJ, K, WW, Q, RR, N, XX, SADSTR, YY, X, ABORT, ZZ and RESET, all of which are also referred to herein. Certain other signals — namely ZF, CLF, NIF, PAROK, BIT 1-6, S, R, REJ, ACC, ONSIG, DD M, TT, TX, CL, CUFRS, ZFIRE, ZP, J, I, and L — are referred to herein and identified in FIGS. 5 and/or 6, but are not specifically shown in FIGS. 7 or 8.

The first three bits of the 24 bit code are ones and modulate the transmitter carrier frequency for a period of approximately 75 microseconds. During this period the receiver front end (constituted by items 37, 38 and 39) detects this signal as an acceptable signal causing the squelch amplifier 66 to lift the squelch signal D.

Signal A is fed into signal converter 73 which produces an output B constituted by positive 200 nanosecond pulses which are either 12.5 microseconds apart or 25 microseconds apart representing transitions of the diphase encoded sigal A.

The diphase encoded signal A comprises a signal having a switching rate equal to the modulating signal bit rate (25 microseconds) whenever the base code is a logical one, and equal to double the bit rate period (12.5 microseconds) whenever the base code is a logical zero, thus producing transitions at 25 and 12.5 microsecond periods respectively.

The logic is so designed as to accept signals which have timing errors of up to 20%. The logic will therefore accept transmission spaced by 10 to 15 microseconds, which is 12.5 microseconds ± 20%, or those spaced at 20 to 30 microseconds, which is 25 microseconds ± 20%.

The logic associated with signal authentication is designed such that those signals whose spacing is less than, say 8 microseconds will cause signal rejection, by means of a zero failure circuit constituted by a one-shot multi-vibrator (O.S.M.V.) 111 and gate 83. Those that occur with a spacing of more than, say, 33 microseconds will cause signal rejection by means of the clock length failure circuit constituted by a one-shot multivibrator (O.S.M.V.) 84 and gate 90.

When signal B consists of two pulses separated by a period of time greater than 17.5 microseconds, a 17.5 microsecond one-shot multivibrator 74 is caused to produce a trigger signal C which, via gate 76, produces signal Z causing data flip flop 75 to reset.

The data flip flop 75 has already been reset due to a reset signal RESET being received as a result of other logic, signalling the end of processing a previous signal, which will be described later.

When signal B consists of two pulses separated by a period less than 17.5 microseconds, the 17.5 microsecond multivibrator 74 is still timing out, thus producing a signal W which allows gate 91 to provide an output FZP which is used to set the data flip flop 75. This in turn provides a decoded base code output H and a second output ZP. The output ZP is used to set a 1st zero flip flop 77 which remains set providing an output FSTR which is used to enable gate 79 until 1st zero flip flop 77 is reset by the signal RESET, which is to be hereinafter described.

In order to generate clock information G, a 1 microsecond one-shot multivibrator 78 is triggered by the trailing edge of output W from the multivibrator 74 every 25 microseconds producing clock pulse CP. Signal G is thus the signal CP, provided that the two inhibits FSTR and J from the 1st zero flip flop 77 and an end of strobe flip flop 80 respectively are removed. Thus, a first zero is so detected and, as will be hereinafter described in greater detail, a previous sensor signal has been processed, completely filling a shift register 81 and setting the end of strobe flip flop 80 via signal I.

In order to ensure that diphase zeros are not accepted if they are constituted by pulses separated by a time period which is less than 8 microseconds, an 8 microsecond one shot multivibrator 111 provides an inhibit signal to gate 91. By way of description, if an 8 microsecond timeout is initiated by the trailing edge of every Z pulse, and a second pulse of the signal B arrives within 8 microseconds of the previous pulse of signal B, the multivibrator 111 functions to inhibit gate 91 via signal V.

A second output L from the multivibrator 111 is used to produce a zero failure signal ZF via a gate 83. The ZF signal output from gate 83 is inhibited, however, by output K from a 45 microsecond one shot multivibrator 82 which will be hereinafter described.

The output ZF is also inhibited unless gate 76 input signals B and C indicate the presence of pulses having intervals which are less than 8 microseconds.

The output signals B are also fed into a 33 microsecond one shot multivibrator 84 in order to perform a further test on the period between pulses. If the period between pulses is greater than 33 microseconds, the multivibrator 84 will produce an output clock failure signal CLF, provided that a gate 90 is not inhibited by the output signal FSTR from the first zero flip flop 77 or by an output JJ from the end of the strobe flip flop 80. This means that measurements are only made on the incoming signal after a first zero is detected and until the shift register 81 has been completely filled.

The output JJ is also used to trigger the multivibrator 82, whose output K is employed to inhibit the gate 83 (as mentioned previously) to ensure that, during the 45 microsecond 'masking' period, spurious zeros do not produce a false signal ZF. The spurious zeroes may be generated in the receiver front end, due to the fall of squelch being slower than the fall of sensor carrier frequency, resulting in noise excursions producing false pulses at B whose periods between pulses are less than 8 microseconds.

After output K from the 45 microsecond multivibrator resets interference flip flop 85, the trailing edge of this 45 microsecond signal triggers a 100 microsecond timeout period of a one shot multivibrator 86 whose output WW enables gate 113; allowing the interference flip flop 85 to be set (due to pulse signals at B) any time during this 100 microsecond period. This indicates an interference condition, producing an output NIF.

The trailing edge of the 100 microsecond output WW initiates a 1 microsecond one shot multivibrator 104 which provides a 1 microsecond delay period or setting time. This delay period is needed to allow Accept and Reject circuit signals (described later) to stabilize before being sampled at the inputs of gates 106 and 116, also described later. The trailing edge of this delay period causes the multivibrator to produce a 1 microsecond pulse Q whose use will also be described later.

The clock pulses G are used to clock the base code signal H into the shift register 81. After 20 clock pulses, the first bit clocked (i.e. the first bit after the zero bit) moves into the 20th bit position. The remaining 19 bits of the transmitter signal are also clocked into their respective bit positions. As the 20th bit position is filled, the output of the 20th shift register flip flop changes state providing an output I which is used to signal the end of strobe flip flop 80, preventing further output of pulses G from gate 79.

As signal G is clocked into the shift register 81 a parity flip flop 95 counts the one bits as they pass. After all the 20 bits have been clocked and the count is odd, an output PAR OK will exist at the output of the parity flip flop 95. If the count is even, output PAR OK does not exist, consequently causing the pulse train to be rejected via an accept-reject gate 97, which is hereinafter described.

Building and floor code signals R and S are monitored by the gate 96 in conjunction with a coding link facility 99. To obtain an accept signal BF OK from the gate 96 it is necessary that the S and R inputs, and also the NIF input, be such as to produce ones at the input to the gate 96. If the input codes S and R are acceptable, the ones in the code are linked to the gate inputs 96 directly and the zeros are linked to the gate input 96 via an invertor 100. This particular receiver is coded to receive only those signals which are associated with transmitters on the floor of that building to which the receiver is allocated.

The six bit signals producing bit signal BIT 1-6 located within the shift register, the parity output PAR OK, squelch input D, and building, floor and noise acceptance signal input BF OK are tested by gate 97, in order to produce an accept or reject signal ACC and REJ respectively.

The squelch signal D should remain lifted for 40 to 50 microseconds after the end of transmission to allow tests to be made for interference. The squelch signal D is also fed into a 1 microsecond one shot multivibrator 98 which produces a trigger pulse ON SIG which in turn may cause gate 101 to trigger a general reset if squelch falls during an 850 microsecond timeout period by a 850 microsecond one-shot multivibrator 92. The ON SIG signal thus indicates the start of a new sensor transmission as determined by the squelch signal D.

A comparison register 93 comprising six latches, whose inputs M contain the sensor address code, will, on application of a 1 microsecond pulse N (whose generation will be described later) to the clock input of the latches cause the inputs M to be memorised at outputs DD. The contents of the comparison register 93 will always be the transmitter address code received from a previous sensor transmission and is stored until it receives a new trigger pulse N.

A comparator 94 performs a bit-by-bit comparison of new and previous sensor addresses by continuously comparing inputs M with outputs DD. If each bit of the new address is the same as the corresponding bit of the old address the output Z FIRE goes high. Output Z FIRE is ignored however until gate 95 is enabled.

If the sensor signal is accepted, gated pulse RR (which is timing pulse Q) at the output of gate 106 is fed into gate 95. During the interval of the pulse RR, the Z FIRE signal is tested at gate 95. If a fire condition is not being signalled then Z FIRE is low and, irrespective of the output from multivibrator 107, which is a 16 millisecond one-shot multivibrator, no pulse will appear at the output of the gate 95.

If a fire condition exists (where Z FIRE is high) then one of two things can happen. If the multivibrator 107 is not timing out, i.e. it has not been triggered by N, no pulse will appear at the output of gate 95. If the multivibrator 107 is timing out then a signal CUFRS is produced causing a current fire flip flop 319 to set.

When multivibrator 107 is triggered by N, it represents an accepted transmission from a transmitter. The purpose of the multivibrator 107 is to discriminate between a real fire condition and a possible false "fire condition". In a "real" fire sensor transmission, the 24 bit pulse train is repeated 20 times with a 200 microsecond interval between pulse trains and a fire burst has a duration of 16 milliseconds, as has previously been stated. If two consecutive transmissions from the same sensor are received within 16 milliseconds without the receiver detecting acceptable transmissions from a second transmitter (and thus a different transmitter address) in between, the first transmitter is deemed to be emitting a fire signal. If the above condition occurs but with a timing of greater than 16 milliseconds then a fire condition will not be recognised. It is possible for two consecutive transmissions to emanate from the same transmitter but these would be spaced by about 1 minute as monitoring mode transmissions.

If the reception of a fire signal is not interfered with, the detection of a fire would be completed after the processing of the second pulse train of the 20 pulse train burst. If interference occurs on the first pulse train (i.e. it is not accepted by one or more of the signal tests) reliance is placed on the second and third pulse train to achieve fire detection. Similarly if interference causes rejection of the first few pulse trains, the first two clear pulse trains result in fire detection. If the interference is from another sensor transmitter which overlaps one or two of the fire pulse trains, then all the overlapped transmissions will be rejected. The fire recognition will then be achieved by two separated clear fire pulse trains (e.g. pulse trains 1 and 4 if the second and third fire pulse trains are overlapped). If the fire signal transmission is overlapped by a series of other sensor transmissions, the separation may extend to up to 18 fire pulse trains (i.e. 14.4 milliseconds) as the worst case possible when the first and the last pulse train in the fire burst will still result in a fire detection.

Gated pulse RR, in addition to being fed into the gate 95, is fed into the one shot multivibrator 105 where the trailing edge of the pulse RR fires the multivibrator 105, producing timing pulses N. These timing pulses N, as mentioned previously, allow the inputs M to be stored in the outputs DD of comparison register 93. This is known as a strobe activity. At the same time, signal N fires the 16 microsecond one shot multivibrator 107 which is thus triggered by every accepted transmission.

The trailing edge of signal N is used to trigger the one shot multivibrator 108 and this in turn serves to generate a transmitter address signal SADSTR. This pulse is used to enable a transmitter address decoder 117 to decode signals DD stored in the six bit comparison register 93, representing the address of the transmitter that has just transmitted. An address output is provided which is fed into its respective fault processing circuits within the dotted outlines 117 to 157, only three of which are shown (FIG. 6B), and also to the inputs of fire processing circuits 158 to 198, only three of which are again shown in FIG. 6B.

The operation of a typical fault and fire processing circuit will be described later.

The trailing edge of the signal SADSTR is used to trigger the one shot multivibrator 109 and this serves to generate a delay of 1 microsecond required to ensure that the trailing edge of the SADSTR pulse does not coincide with the start of the general RESET pulse X. The trailing edge of a 1 microsecond delay signal YY is used to trigger a one shot multivibrator 110 which serves to generate the reset pulse X, which is fed to a reset multivibrator 115 and to the gate 101.

The normal signal processing action of the general RESET circuits comprising multivibrator 92, flip flop 102 and multivibrator 115, and gate 101 is as follows.

The override time out 850-microsecond multivibrator 92 is fired by the setting of the first zero-detect flip flop 102 via signal FZP which is supplied by gate 91. The output from the multivibrator 92, ZZ, causes reset multivibrator 115 to reset due to either an input CL being present prior to the expiry of the 850 microsecond timeout period or by the natural expiry of the 850 microsecond period.

The clear input CL can be forced low by any of the following fire test pulses appearing at the input of gate 101: Z FAIL, CLF ON SIG, ABORT, or X.

The ABORT signal is generated at the output of gate 116 if a reject signal REJ is present at the output of gate 97. Gate 116 is thus enabled by signal REJ and therefore allowing pulse Q to become the signal ABORT.

Termination of the output from the multivibrator 92 by the natural expiry of the 850 microsecond timeout is required to guard against the possibility of a transmission ceasing midway through the pulse train (due to a noise burst etc), leaving the shift register part filled, and the circuits being unprepared for a subsequent transmission. In general, should any of the five test pulses above fail, the natural expiry will ensure the resetting of signal processing circuits.

The operation of one of the fault processing circuits 117 to 157, (e.g. 117) and one of the fire processing circuits 158 to 198 (e.g. 158) referred to previously is now described.

Sensor presence flip flop 190 is reset at the beginning of a 10 minute cycle by a signal TX from a 10 minute timer flip flop 191. The sensor presence flip flop 190 is thus set to wait for the reception of a presence transmission from sensor address decoder 117. During the following 10 minute interval, several monitoring transmission are expected (up to 10 in 10 minutes). When a transmission is received, the presence flip flop 190 will memorize this fact by changing its output to a set state.

At the end of the 10 minute cycle the sensor fault flip flop 192, is triggered by an output TT from the 10 minute timer flip flop 191, causing the output from sensor presence flip flop 190 to be tested.

If the presence flip flop 190 has been set, indicating that the sensor is functional, the output of detector flip flop 192 does not change state and consequently no further action occurs. If the presence flip flop 190 output is not set (i.e., remains reset), indicating that not one presence transmission has been received during the last 10 minutes, the test fails. This causes the sensor fault flip flop 192 to be set and a fault lamp 193 will light.

The sensor fault flip flop 192 and lamp 193 remain in this state until manually reset by a fault reset push button 194.

The 10 minute timer 191 is also reset by the action of closing the fault reset push button 194.

The cycle of operation of the timer 191 is such that output pulses TT and TX are continuously generated a 10 minute intervals.

Current fire flip flop 319, when set by a trigger pulse CURFS, produces an input signal to all gates 195 to 235 associated with all fire processing circuits 158 to 198. At the same time the sensor address decoder 117 provides an output to a particular address associated with the fire processing circuits 158 to 198, enabling one associated gate, for example gate 195, to produce a signal output GG setting sensor fire flip flop 236. When sensor fire flip flop 236 is set an associated fire lamp 227 will light and remain lit until a manual fire reset push button 318 is depressed, whereupon the sensor fire flip flop 236 is reset and the lamp extinguished.

The current fire flip flop 319 is used to memorize a fire condition for just sufficient time to set one of the sensor fire flip flops 236 to 276, and to permit the sensor code to be decoded so as to determine which detector has sensed the fire.

At the end of processing the fire pulse train the current fire flip flop 319 is reset by the signal process reset multivibrator 115 so that it is ready to receive a fire detection from another related transmitter.

I claim:

1. A wireless information system transmission system comprising at least two radio frequency signal transmitting means and at least one receiving means associated with the tranmsmitting means, each of the signal transmitting means being arranged to transmit in first and second modes, the first mode being a monitoring mode wherein monitoring mode signals which have a duration $\delta t$ and a repetition rate such that said monitoring mode signals are spaced apart by intervals of time $t >> \delta t$ are employed to modulate a radio frequency carrier signal, the time interval $t$ between successive monitoring mode signals being allowed to drift randomly between each of the transmitting means, the second mode being an alarm mode, which is established in response to an alarm inducing condition, wherein alarm mode signals having the same duration $\delta t$ as the monitoring mode signals are employed to modulate the carrier signal, the alarm mode signals having a repetition rate greater than the repetition rate of the monitoring mode signals and being spaced apart by time intervals $\alpha t$, each said monitoring and alarm mode signal associated with the respective transmitting means being composed of a coded pulse train, the receiving means being arranged to receive and detect signals from the transmitting means, the receiving means being arranged to provide an output responsive to a change occurring in the mode of transmission by the transmitting means and to provide an output if no signal having the duration $\delta t$ is detected within each period of successive predetermined fault detecting periods of time $xt > t$, and the receiving means being arranged to provide an alarm indicating output if at least one signal of duration $\delta t$ is received and detected within a receiver alarm detection period of time $\beta t$, where $\alpha t \leqq \beta t < t$, following receipt of a preceding such signal.

2. An information transmission system as claimed in claim 1, in which the monitoring mode signals have a said duration $\delta t$ falling within the range 200 microseconds to 5 milliseconds, and the monitoring mode signals are spaced apart by a said time $t$ falling within the range 30 seconds to 2 minutes.

3. An information transmission system as claimed in claim 1 in which:

the monitoring mode signals and the alarm mode signals each have a duration $\delta t$ falling within the range 200 microseconds to 5 milliseconds;

the monitoring mode signals are spaced apart by a said time $t$ falling within the range 30 seconds to 2 minutes;

the said fault detection period $xt$ falls within the range 5 minutes to 60 minutes;

the alarm mode signals are spaced apart by a said time $\alpha t$ falling within the range 100 microseconds to 5 milliseconds; and the said alarm detection period $\beta t$ falls within the range 100 microseconds to 20 seconds.

4. An information transmission system as claimed in claim 1, in which the respective said pulse trains are composed of a predetermined series of logical ones and zeros which are generated within a said transmitting means to constitute a multibit base code.

5. An information transmission system as claimed in claim 4, in which a plurality of said transmitting means are associated with any one said receiving means; a number of the bits of the base code generated within respective ones of the transmitting means being representative of the address of the respective transmitting means.

6. An information transmission system as claimed in claim 4, in which the base code is employed to modulate the radio frequency carrier signal.

7. An information transmission system as claimed in claim 4, in which the base code is employed to first modulate a signal which is in turn employed to drive a diphase generator, the diphase generator providing an output which is representative of the base code and the output from the diphase generator being employed to modulate the radio frequency carrier signal.

8. An information transmission system as claimed in claim 5 in which, at the receiving means, signals representative of the bits of the transmitted base code are generated, bits of the said generated signals corresponding to the address bits of the transmitted base code are stored, and the stored bits are compared with previously stored bits of a preceding said generated signal; and wherein an output signal representative of an alarm condition is generated if parity exists between the compared bits and if the time interval between storage of the respective compared bits in within the period of time $\beta t$.

9. An information transmission system as claimed in claim 8, in which the bits of the said generated signals corresponding to the address bits of the transmitted base code are decoded to provide an address signal; and wherein the address signal and any said output signal representative of an alarm condition are gated to initiate together an alarm signal at the receiver.

10. An information transmission system as claimed in claim 5 in which, at the receiving means, signals representative of the bits of the transmitted base code are generated, component bits of the said generated signals corresponding to the address bits are decoded to provide an address signal, the address signal is applied to a signal presence detecting device, and an output signal representative of a monitoring signal from a particular transmitting means is generated if at least one address signal is applied to the signal presence detecting device within the period of time $xt$.

11. An information transmission system as claimed in claim 1 including a sensor arranged to detect for the existence of an alarm inducing condition, the sensor being associated with the transmitter means.

* * * * *